United States Patent [19]

Wright

[11] Patent Number: 4,683,990

[45] Date of Patent: Aug. 4, 1987

[54] RELATIVE POSITION MONITORING APPARATUS

[75] Inventor: Mark W. Wright, Russellville, Ark.

[73] Assignee: Innovation Industries, Inc., Russellville, Ark.

[21] Appl. No.: 770,527

[22] Filed: Aug. 29, 1985

[51] Int. Cl.[4] ..... B66B 3/02

[52] U.S. Cl. ..... 187/134; 187/136

[58] Field of Search ..... 187/130, 134, 136

[56] References Cited

U.S. PATENT DOCUMENTS

| | | | |
|---|---|---|---|
| 1,578,783 | 3/1926 | Van Bloem | 187/134 |
| 2,246,921 | 6/1941 | Kummer | 187/136 |
| 2,840,188 | 6/1958 | Savage | 187/134 |
| 2,938,603 | 5/1960 | Loughridge | 187/134 |
| 3,636,506 | 1/1972 | Kirsch | 187/136 |
| 4,427,095 | 1/1984 | Payne et al. | 187/134 |

FOREIGN PATENT DOCUMENTS

| | | | |
|---|---|---|---|
| 1094760 | 12/1967 | United Kingdom | 187/134 |
| 2165966 | 4/1986 | United Kingdom | 187/134 |

*Primary Examiner*—William M. Shoop, Jr.
*Assistant Examiner*—W. E. Duncanson, Jr.
*Attorney, Agent, or Firm*—Stephen D. Carver

[57] ABSTRACT

A relative position derivation, sensing and indicator system primarily adapted for conventional elevators. The system displays elevator position and travel direction at each floor with a relatively old fashioned appearing indicator apparatus including an "antique" faceplate and a simple rotatable pointer arm driven by a stepper motor assembly. Electronic solid state digital circuitry is employed to derive suitable control signals for driving the associated stepper motors which rotate the pointer arms associated with each position displayed. A plurality of vanes vertically aligned within the hoistway are provided with parallel, offset rows of perforations. A generally U-shaped vane reader traveling with the elevator car establishes a pair of rapidly pulsed, oppositely directed infrared light beams across a void-like channel formed between its sides. Suitable photoresponsive elements in the vane reader may receive and interpret the light pulses to sense the presence or absence of interposed vanes (and vane perforations) to derive digital data during car movement. Correlation means in the vane reader are provided to output two pairs of control signals, which are delivered to an associated drive circuit for correlating and generating a pair of complementary clock signals and a pair of complementary direction signals. A stepper motor processor correlates and processes the last mentioned signals for ultimately controlling associated stepper motor actuation circuits associated with the multiple stepper motors employed in conjunction with the indicator apparatus disposed at each floor.

42 Claims, 14 Drawing Figures

FIG.9
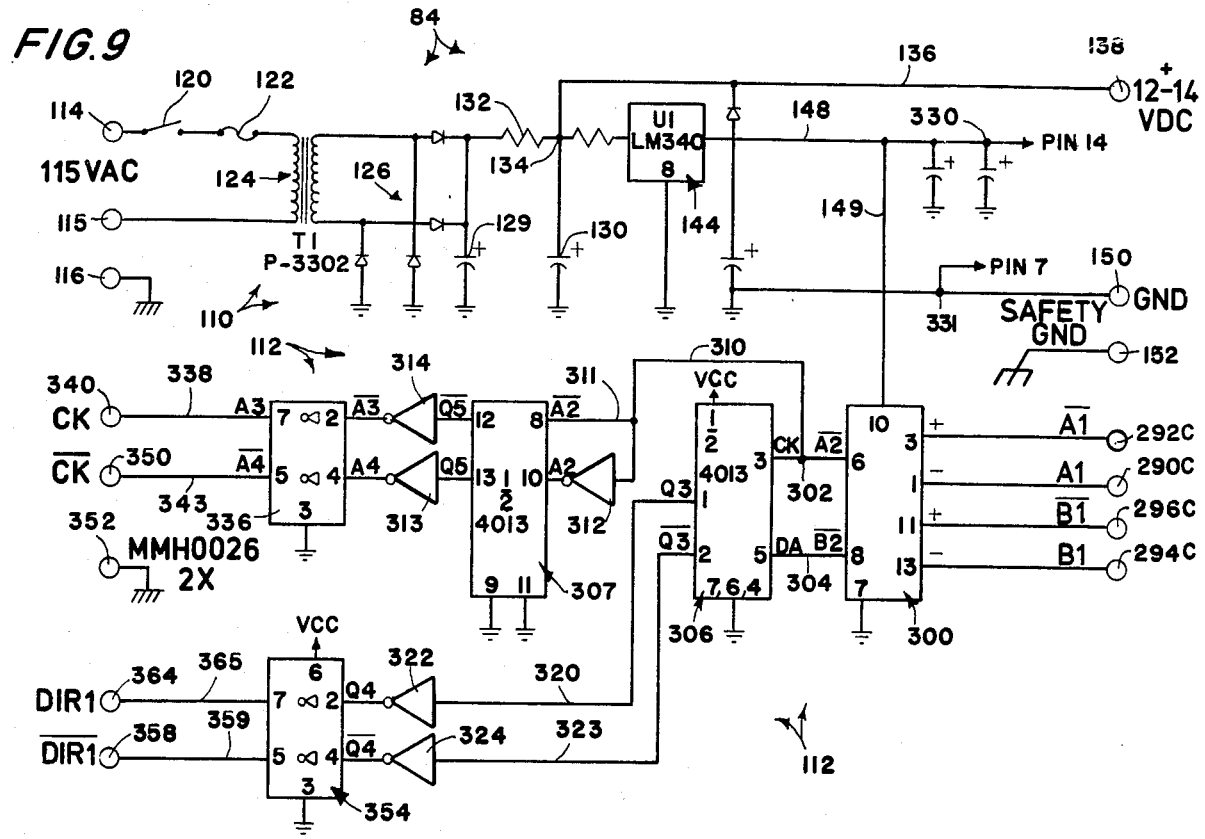
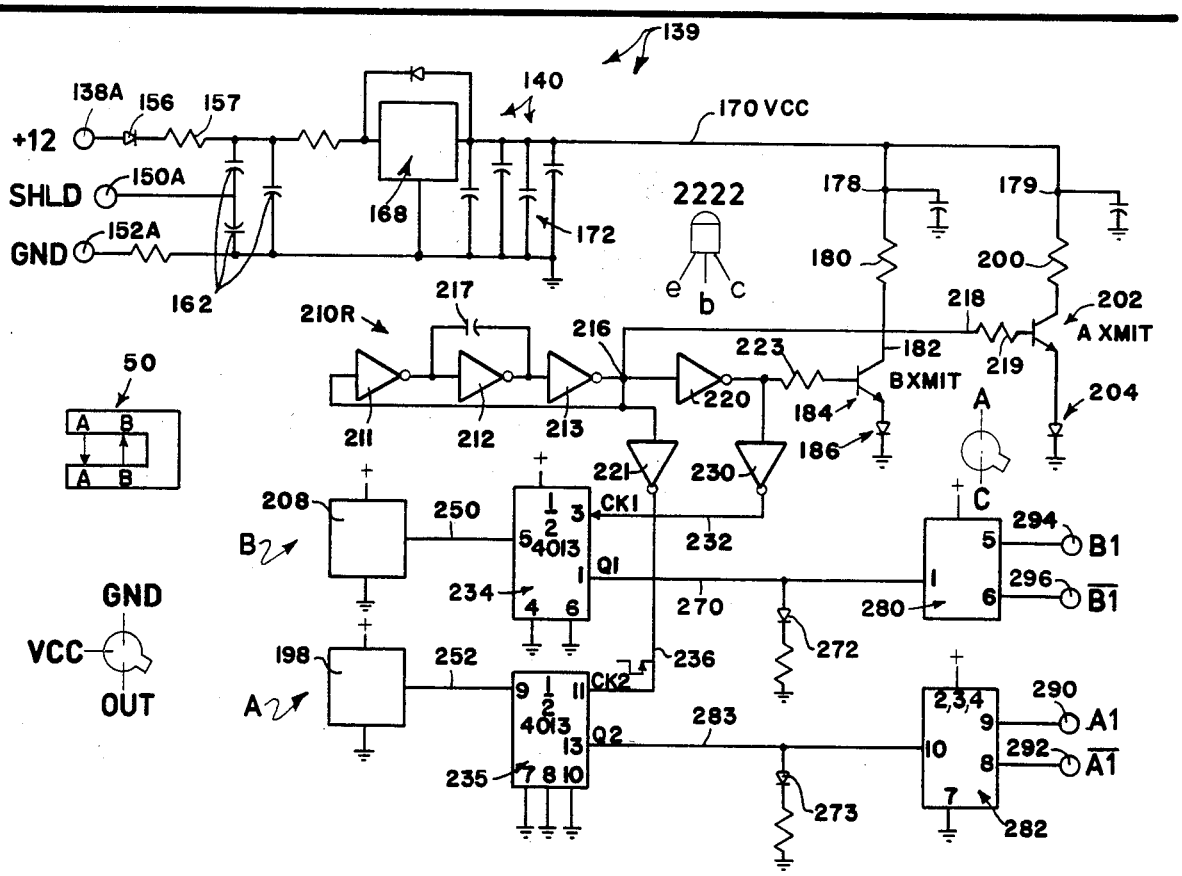
FIG.10

FIG.11
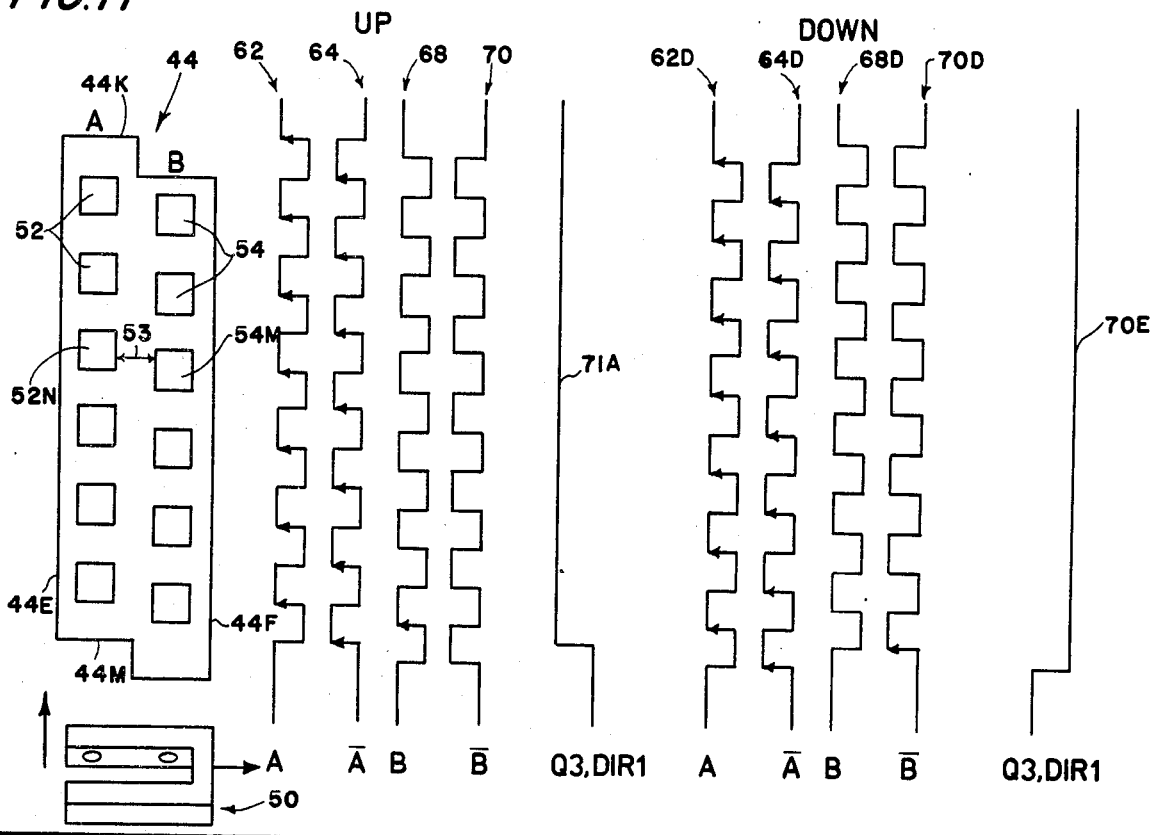
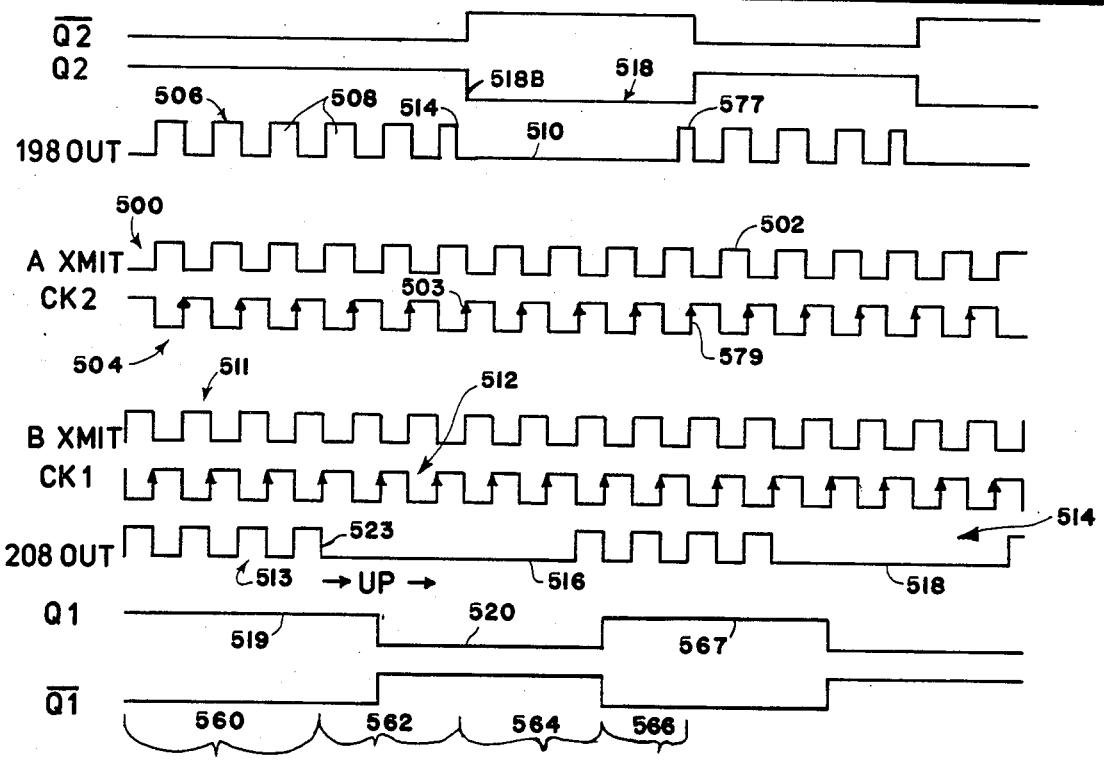
FIG.12

RELATIVE POSITION MONITORING APPARATUS

BACKGROUND OF THE INVENTION

The present invention relates generally to position determining and display apparatus. More particularly, the present invention relates to a solid state system for digitally monitoring and sensing relative elevator car position and direction of travel.

In the prior art a great deal of position control technology has been suggested for monitoring and controlling elevator cars. The use of photo cells in elevator systems, broadly speaking, is well known. The concept is broadly depicted, for example, in U.S. Pat. No. 3,816,745 owned by the same assignee as in the instant case. A wide variety of previous designs have sensed elevator car position by reading perforated tapes and the like disposed in the conventional elevator hoistway. Some form of sensor apparatus may be employed for generating optical or electrical pulses as suitable sensors are moved relative to perforated tapes, vanes or the like.

U.S. Pat. No. 3,414,088 issued Dec. 30, 1968 employs a photocell system for detecting absolute car position through pre-punched tape coded with suitable "absolute position" indicating indicia. Caputo U.S. Pat. No. 4,019,606 discloses a system for determining through opto-electronics the position of an elevator car relative to a selected landing, wherein a photosensitive transistor senses light pulsed by a light emitting diode. U.S. Pat. No. 3,483,950 also discloses a photocell employed in a system for determining absolute position. U.S. Pat. No. 3,749,203 contemplates the use of perforated vanes through which light is passed periodically to determine absolute position. Similarly, U.S. Pat. No. 4,433,756 and U.S. Pat. No. Re. 27,185 also disclose complex absolute position monitoring apparatus wherein position is ascertained through optic readers employing elongated perforated tapes. U.S. Pat. No. 3,963,098 discloses a highly complex system for determining absolute position of an elevator car in response to the reading of a precoded tape. U.S. Pat. No. 3,773,146 discloses an electronic elevator position control device which monitors absolute position from data derived from predetermined elevator car positions.

Position sensing systems employing magnets are disclosed in U.S. Pat. No. 3,339,231. Savage in U.S. Pat. No. 3,856,116 includes an electro-mechanical device actuated by suitable cams for mechanically sensing absolute position. Magnetic position sensing systems are also disclosed in U.S. Pat. Nos. 3,048,818 and 3,199,630.

Most of the devices disclosed in the aforementioned patent references indicate elevator car position through relatively sophisticated display systems comprising a plurality of sequentially activated indicator lights or the like. However, in relatively recent years, partly because of aesthetics and "taste", architects, interior decorators, planners and the like have expressed a desire to deploy apparatus which emulates "old fashioned" position display systems. The older systems usually included a decorative cover plate provided with a plurality of suitable position calibrations. Usually a suitable pointer was employed to revolve relative to the cover plate in response to elevator car travel.

Thus a modern car position display system ornamentally reminiscent of the "old fashioned" variety is desirable. Of course it is further desirable to replace "multiple light" display systems without exchanging the originally installed elevator hoist control and travel apparatus, and without sacrificing reliability, dependability or speed. Therefore it is necessary to provide a highly reliable digital system for controlling an "antique" position display apparatus, incorporating all of the benefits of solid state technology.

Such a system must reliably operate within the extremely hostile environment of an elevator system. For example, the employment of digital control systems in the electrical environment of an elevator subjects the digital circuits to constant transients and spikes caused by the inductive nature of elevator motor technology. Moreover, it is desirable to provide a display system such as that of the present invention which may be retro-fitted to exist in systems without changing the complex and expensive elevator acceleration, deceleration and control apparatus already existing.

SUMMARY OF THE INVENTION

The present invention comprises a relative position monitoring system, and a reader device for such a system, for generating and providing an "analog" visual indication of the position of a traveling object. More particularly, the present invention provides relative position monitoring apparatus primarily for use with elevator cars which may be either installed in new buildings or retro-fitted to existing elevator systems.

The system contemplates a plurality of "antique-like" displays comprising generally semi-circular shaped base plates suitably calibrated to provide a visible indication of elevator car position in response to the controlled rotation of a simple pointer. Suitable stepper motors are employed to rotate the pointers, and associated stepper motor control circuitry provides incrementally controls the stepper motor.

In the best mode a plurality of separate, preferably identical perforated vanes are employed for data generation. The vanes are adapted to be disposed along the path of travel of the object to be monitored. Each of the perforated vanes is encoded identically, and each includes spaced apart and offset first and second rows of perforations. The vane reader device includes a generally U-shaped housing having a pair of sides separated by an intermediate gap across which beams of infrared light are established. Preferably the vane reader includes first and second infrared emitting diodes (IRED's), which aim light in different directions across the channel. This light is pulsed rapidly by associated oscillator circuitry, and if passage is unblocked the light impinges upon suitable photosensitive transistors, which output to suitable correlators.

A pair of oppositely aimed light beam pathways are thus established by the vane reader, and depending upon the blockage or unblockage of these pathways (by the vanes which will be periodically interposed between the vane reader sides) relative position is determined. An A channel of perforations established by each vane is separated from a B channel series of perforations, and an A light beam pathway and a B light beam pathway supplied by the vane reader are respectively aimed across the A and B vane perforations during elevator movement.

A pair of complementary position indicative signals are derived from the A and B light beams through suitable correlators, which essentially "clock" received information from the phototransistors against substantially concurrent "transmit indicative" information. In other words, information received by the phototransistors is further processed if and only if proper initial IRED transmissions in fact occurred. Significant reduction of noise sensitivity and crosstalk result.

Importantly, since only relative elevator car position is being monitored, each of the vanes may be identical, and no specific digital encoding is required for the rows of perforations, unlike prior art devices. Preferably the A channel perforations are offset slightly for the B channel perforations, and sensed phase differences between the twin light pathways determined as the vane reader moves enables the ultimate digital determination of direction control.

Within the vane reader an A1 and NOT A1 signal are derived by clocking data received from the A channel photo responsive transducer against the drive signal from the A channel IRED. Similarly, a B1 and NOT B1 signal are derived by suitably correlating the output of the B channel phototransducer by clocking it against B channel IRED drive information.

Further multiple correlation and clocking circuitry is employed in the drive circuitry described herein to generate suitable clock and directional signals. The vane reader signals A1, NOT A1, B1 and NOT B1 are coupled to suitable inputs nodes of a remotely disposed drive circuit through matched communication devices. The drive circuit outputs a NOT A2 signal by NAND gating the NOT A1 signal with the A1 signal. The NOT B1 signal inputted to the drive circuit is similarly NAND gated by the B1 signal to output a NOT B2 data signal. This further reduces transmission errors caused by noise, ambient light, voltage spikes, transients and the like.

In the drive circuit the leading edge of the NOT A2 signal clocks against the NOT B2 data to generate a pair of complementary clock signals which are further processed to provide a pair of direction control signals ultimately employed for stepper motor direction control and derivation. Direction is thus ultimately established based upon whether or not a sensed A transmission is interrupted before the sensed B signal or vice versa. The NOT A2 and a complementary A2 signal are further processed to provide clock signals for incrementing the stepper motors.

The output signals from the drive circuit are delivered to a stepper motor control circuit, equipped with an optic coupler which gates the CK clock signal with the NOT CK clock signal to output a CK2 clock signal. Similarly the DIR signal is gated by the NOT DIR signal to obtain a DIR2 output. In this fashion continuous continuity is insured because NAND gate logic is employed to provide incremental counts only when both of the original A and B signals developed across the vane reader are properly timed. The outputs from the stepper motor control circuit are delivered to appropriate pins on a conventional stepper control circuit board, which operates a conventional stepper motor to mechanically rotate a position indicator pointer.

Thus a plurality of complementary signal paths throughout the circuitry of the system are redundantly correlated to insure electrical immunity from the spikes, noise, transients and the like encountered in conventional elevator installations.

Accordingly, a broad object of the present invention is to provide a system for monitoring, determining, and displaying the relative position of a traveling object, such as an elevator car or the like.

A similar object of the present invention is to provide a solid state digital system for reliably controlling an antique or "old fashioned" pointer-equipped elevator position indicator apparatus.

Yet another object of the present invention is to provide a system of the character described which may be employed in cooperation with preexisting elevator car handling and travel control systems, and which may therefore be retro-fitted to existing elevator systems.

Another basic object of the present invention is to provide a reliable solid state relative position determining and display system which functions reliably in the hostile elevator hoistway environment. For example, it is a feature of this invention that protection against error caused by incident ambient light within the elevator hoistway, and concurrent protection against the large voltage transients and spikes generated by the inductive nature of elevator control systems, is provided.

A similar object of the present invention is to provide a relative position control and display system of the character described which may be adapted for use with elevators with a variety of different numbers of landing positions.

A similar and basic object of the present invention is to provide a system for relative elevator car position display which overcomes problems with building compression and the like. It is a feature of the present invention that no absolute position encoding of perforated vanes etc., is necessary. Thus a plurality of separate, identically coded perforated vanes may be employed.

Another related object of the present invention is to provide a system for relative elevator car position determination which will work with a multiplicity of inexpensive and identical vanes equipped with similar patterns. Therefore it is an object as well to avoid the necessity of employing photo-optic vane encoding apparatus which must be encoded for each particular floor.

Yet another object of the present invention is to avoid the use of mechanical or magnetic storage and sensing elements such as magnetically switched proximity relays.

A further object is to provide a relative position monitoring apparatus of the character described which avoids the use of prior art control cams and the like.

A fundamental object of the present invention is to provide a relative position control system of the character described which is inherently protected from errors typically caused from power line surges, glitches, transients, and the like.

A still further object is to avoid the necessity of searching for or measuring analog current changes in optical sensing apparatus. A disadvantage associated with prior art photo-optic systems is that absolute elevator position monitoring systems usually must derive certain control data from analog changes in reflected or incident light.

Yet another object of the present invention is to provide a solid state control system which digitally determines and constantly correlates a pair of optical/electrical data channels independently of elevator car position, speed, acceleration or velocity.

A fundamental object of the present invention is to avoid the use of photo-optic tapes which have hitherto been custom programmed for individual installations.

Yet another object of the present invention is to completely avoid the use of pulse wheels, governor sheaves, and other electro-mechanical counters.

Another fundamental object associated with the circuitry of the present design is to avoid the use of relatively unreliable decoding matrices.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 9 is an electrical schematic diagram of the preferred optical vane reader power supply and derived information processing circuit;

FIG. 10 is an electrical schematic diagram of the preferred optical-electrical data generation circuit and transmission circuit of the optical vane reader;

FIG. 11 is a combined diagramatic and timing diagram illustrating waveforms corresponding to the presence or absence of a completed optical transmission path and associated direction control signals derived by the present apparatus;

FIG. 12 is a timing diagram illustrating critical timing relationships developed in the circuits of FIGS. 8–9;

DETAILED DESCRIPTION OF THE DRAWINGS

Figure 1:
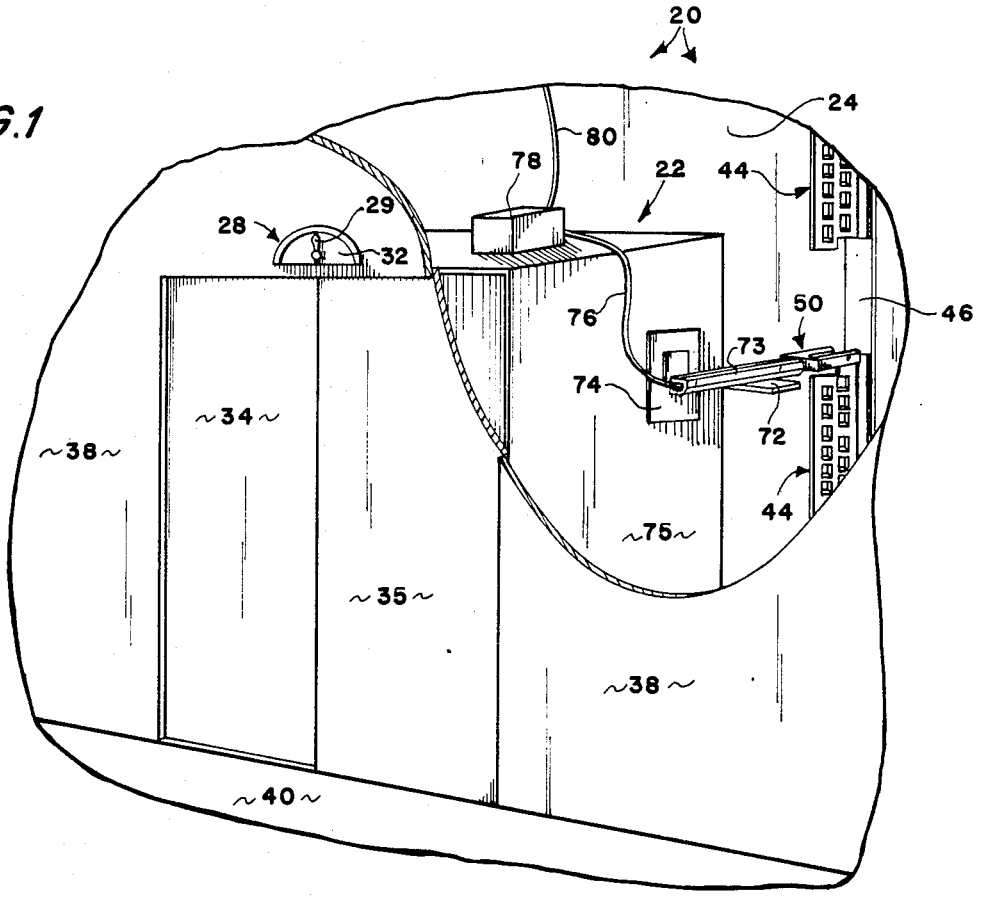
FIG. 1 is a fragmentary, isometric view illustrating key portions of the present invention installed in association with a conventional elevator system car disposed for operation within a conventional hoistway, with portions thereof omitted for brevity or broken away for clarity.

With reference now to the appended drawings, a relative position monitoring apparatus constructed in accordance with the best mode of the present invention has been generally designated by the reference numeral 20. While system 20 is preferably adapted for use with elevators equipped with conventional veritcally traveling cars, the invention may be employed equally successfully to monitor and display the position of a wide variety of moveable items, such as products moving through an assembly line, and the system 20 may be easily adapted for use in conjunction with objects moving horizontally or between any generally colinear points.

Figure 7:
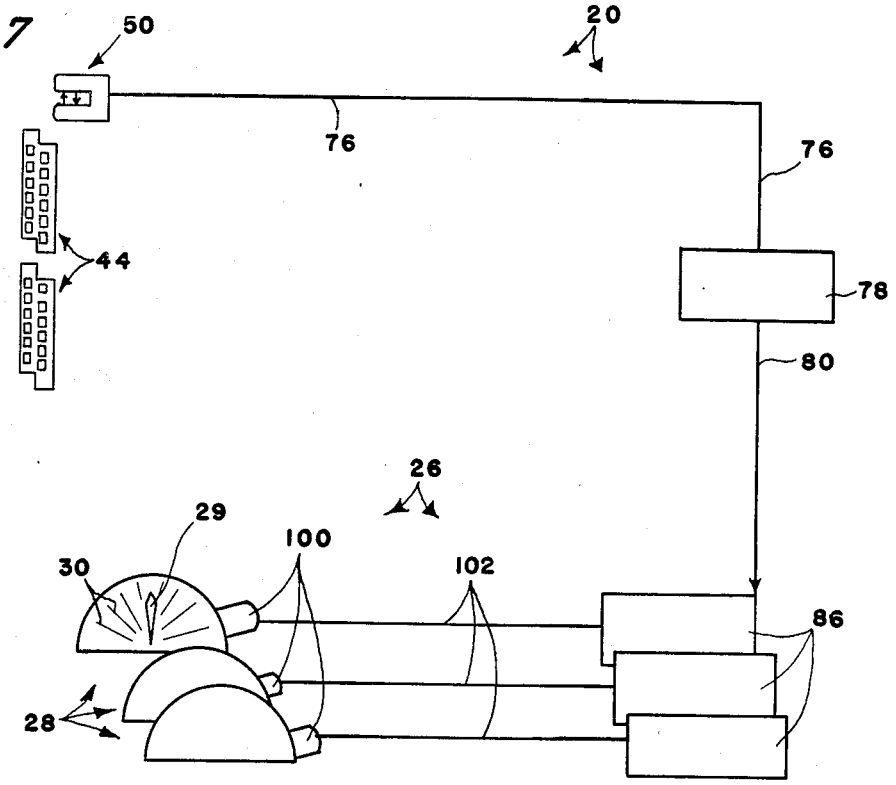
FIG. 7 is a diagramatic block diagram of the relative position monitoring apparatus of the present invention.

With reference to FIG. 1, the apparatus 20 is adapted to monitor the position of a conventional elevator car 22 which is disposed for controlled vertical movement within a conventional hoistway 24. Apparatus 20 provides an indication of the elevator floor position by driving a suitable stepper motor assembly 26 which ultimately controls a car position indicator 28. A block diagram of the overall system 20 is best illustrated in FIG. 7 Travel of elevator car 22 may be controlled by separate conventional apparatus not comprising a part of the present invention. Suitable conventional elevator control systems with which the relative position system 20 may be successfully employed have been described in a variety of the previously discussed prior art patents.

Regardless of the elevator car motion control hardware and circuitry, the relative position derivation and monitoring system 20 is adapted to generate and indicate readings of car position upon a plurality of stepper-motor-driven indicators 28, one of which will be associated with each floor constituting the route of the elevator car 22. Each of the position indicators 28 includes a suitable rotatable pointer 29 for indicating floor position by aligning with suitable calibrations 30 defined upon the face of the ornamental indicator plate 32. As will readily be appreciated by those skilled in the art, once the car 22 reaches its intended destination, the conventional elevator car control and sensing apparatus (not a part of the present invention) will suitably activate the conventional doors 34, 35 which are slidably operable within suitable guide channels installed conventionally relative to the wall structure 38, for admission or discharge of passengers upon or through the adjacent conventional floor 40.

Each display unit 28 preferably comprises an antiqued, ornamental and aesthetically pleasing metallic indicator plate 32 of generally semicircular dimensions from which relative elevator car position and present travel direction (if the car is moving) may be ascertained by visual inspection of the associated ornamental pointer 29. System 20 enables the building designer, architect, decorator or the like to create a pleasing "old fashioned" elevator position indicator appearance, obviating the necessity of installing conventional "modern" multiple light car position display systems. However, while permitting the installation of aesthetically desirable position indicator displays which externally appear "old fashioned" to the elevator passengers, the solid state control circuitry to be hereinafter described insures accurate and dependable relative position readings. Furthermore, the hitherto undesirable characteristics of innaccuracy or dubious reliability associated with older position determination and monitoring systems employing display units similar to unit 28 are avoided.

Figure 5:
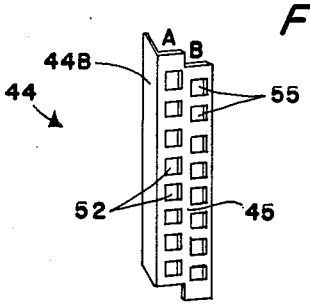
FIG. 5 is an isometric view of a preferred perforated vane constructed in accordance with the teachings of the present invention.

In accordance with the teachings of the present invention a plurality of generally axially aligned, vertically spaced apart perforated vanes 44 are adapted to be securely disposed vertically within the hoistway 24, being suitably attached to a conventional stanchion 46 or the like, which may extend vertically upwardly in generally space apart relation within the structural confines of the hoistway. With reference to FIGS. 1, 5 and 11, a plurality of separate, vertically spaced apart vanes 44 are serially axially aligned within the hoistway, and include a plurality of perforations which are "read" (as will hereinafter be described in detail) by the generally U-shaped traveling optical vane reader device 50 which is adapted to optically generate position data in response to the "making" or "breaking" of a pair of infrared light transmission paths. Preferably a cooperative and phase related pair of pulsed light beams are transmitted between opposite halves of the vane reader 50, and important data is generated in response to the interruption (or non-interruption) of these light transmission pathways.

With reference now to FIGS. 1, 5, 7, and 14, each of the vanes 44 preferably comprises a pair of spaced apart rows of generally square timing perforations. Each vane 44 preferably includes a first row (denoted A) of serially spaced apart perforations 52 defined upon its major body portion 45, and a spaced apart generally parallel but offset similar row of multiple perforations 54 (denoted B). From FIG. 6 it will be appreciated that each vane 44 is of generally L-shaped vertical cross section, comprising an integral folded base portion 44B which is adapted to be secured to the supporting stanchion 46 or suitable alternative structure within the hoistway as previously described (FIG. 1).

Figure 13:
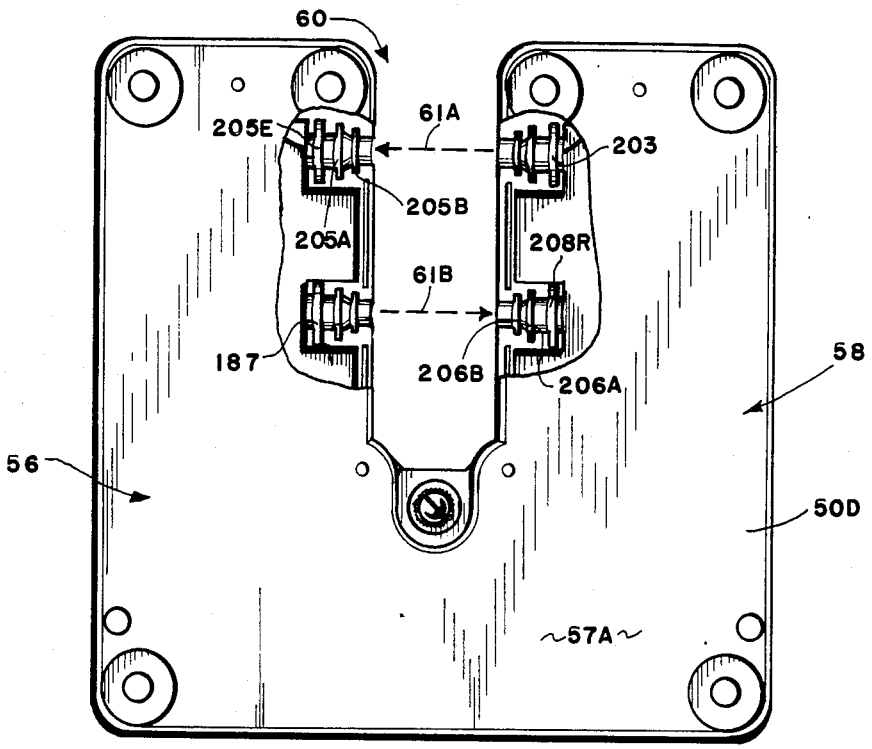
FIG. 13 is a fragmentary, plan view of the preferred optical vane reader device; and, FIG. 14 is a fragmentary sectional view of the preferred optical vane reader device.
Figure 14:
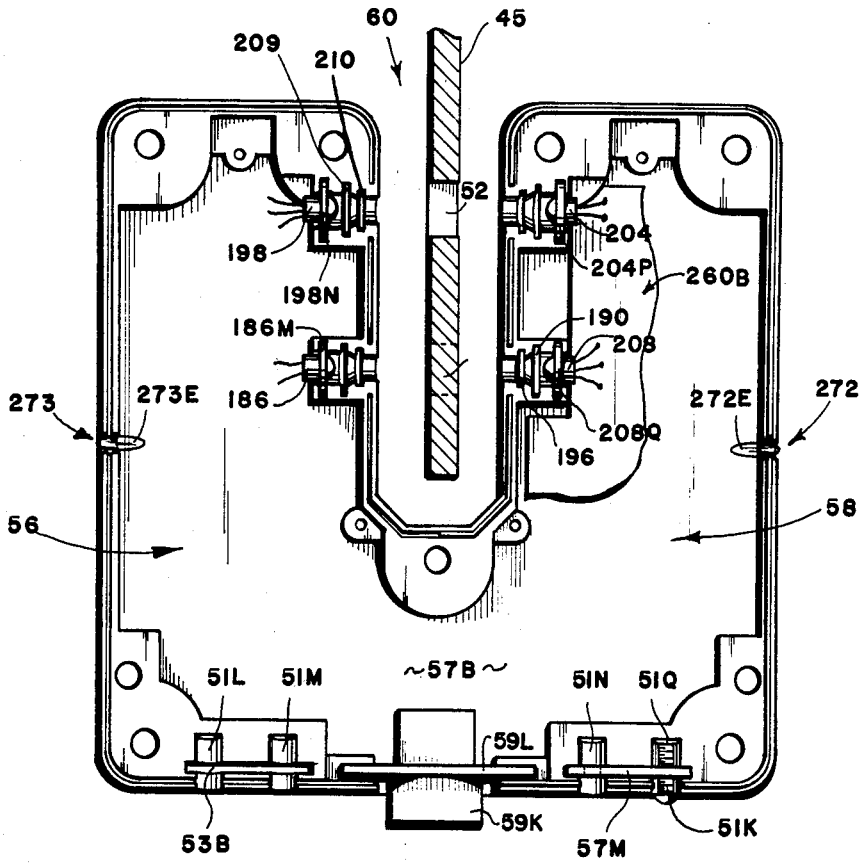

As indicated in FIGS. 11 and 13–14, the optical vane reader 50 is preferably generally U-shaped, and it includes a pair of equally dimensioned and spaced apart sides 56 and 58 separated by a channel-like space generally designated by the reference numeral 60. The vane reader 50 preferably comprises a housing 50D comprised of a pair of mating halves 57A and 57B. As will be best appreciated from an inspection of FIG. 14, and as will be hereinafter described in detail, a pair of oppositely aimed infrared light transmission pathways, generally indicated by arrows 61A and 61B (FIG. 13) are established between vane sides 56 and 58. With reference to FIG. 14, during at least a portion of car travel the body 45 of each stationary vane 44 will be at least temporarily disposed within the channel 60 of the moving vane reader 50. During movement of the car (and the associated vane reader) light transmission between either or both transmission pathways may be periodically interrupted (and reestablished) by each vane 44, since the perforated and aligned major body portions 45 of each vane 44 will be periodically disposed within the traveling vane reader cavity 60.

The bottom of the vane reader housing is provided with a plurality of cylindrical bosses 51L, 51M, 51N and 51Q. Suitable lateral grooves such as groove 53B are provided in association with pairs of the aforementioned cylindrical bosses to receive conventional nut strips such as nut strip 57M for threadably receiving screws 51K. Electrical connections exteriorly of the housing are facilitated by a conventional terminal 59K mounted by an anchor 59L. With reference now to FIGS. 1–4 and 6–7, vane reader 50 may be mounted by a suitable outwardly extended and tubular support strut 73 which is secured to a cooperating brace 72 projecting outwardly from the side 75 of the elevator car 22 and preferably attached thereto via integral base portion 74.

Figure 6:
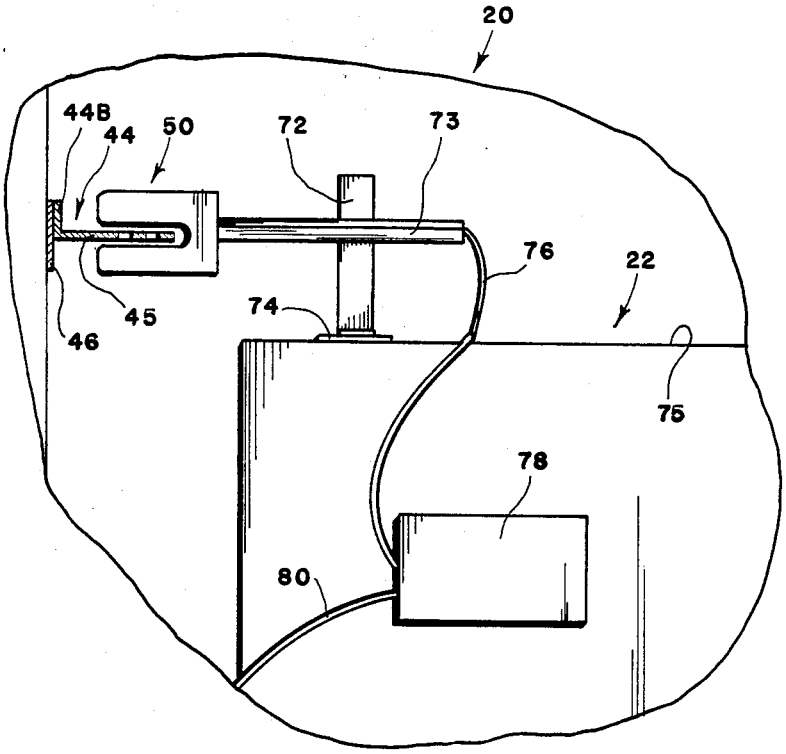
FIG. 6 is an enlarged, fragmentary view of a portion of the vane reading apparatus and associated hardware.

Again, with reference to FIGS. 6 and 11, the optical vane reader 50 operationally moves relative to the vane body portions 45 which will periodically be disposed within the vane channel 60 between sides 56 and 58, and, as a result, critical timing waveforms will be generated as the light paths are periodically broken when solid portions of the vanes 44 are interposed. Similarly, light pathways 61A and/or 61B will be periodically reestablished when the vane reader 50 is suitably oriented relative to the "surrounded" vane orifices 52 or 54.

With reference now to FIG. 11, the waveforms labeled A and NOT A are generally designated by the reference numerals 62 and 64 respectively. Similarly, the optical vane reader 50 will generate a pair of waveforms 68 and 70 labeled B and NOT B. When these signals are "high" the light path from which they are generated is complete (i.e. uninterrupted). Waveforms 62, 64, 68 and 70 are generated when the elevator car moves upwardly. A similar but out-of-phase set of waveforms 62D, 64D, 68D and 70D are generated when the elevator car moves downwardly.

As shall be hereinafter described in detail, these critical timing signals generated from passage of the vane reader device 50 over sequentially disposed vanes 44 will ultimately control operation of the present apparatus. A first direction sensing signal 71A (i.e. an "up" signal labelled Q3) is generated electronically from the phase difference between signals 64 and 70. A second direction sensing signal 70E (i.e. the "down" signal version of Q3) is generated from the phase difference between waveforms 64D and 70D. With reference to FIG. 11, since the orifices 54 are positioned in offset relationship from the similar, parallel and spaced apart row of orifices 52 pairs of out-of-phase timing signals result.

Control signals and power line signals which are transmitted to and from the optical vane reader device 50 are passed through a multi-conductor electrical cable 76 so that suitable circuitry (FIG. 10) disposed upon a suitable electrical circuit board located within the vane reader housing may operate. Conduit 76 is interconnected with a suitable junction box 78 secured to the elevator car, the output from which is transmitted through the conventional multi-conductor elevator traveling control cable 80 which is suspended within the hoistway 24 in a conventional fashion. Power, control data and other derived signals are generated within circuitry 84 (FIG. 9) which may be disposed within enclosure 78. Data transmitted via distribution line 80 (FIG. 7) reaches each of the stationary stepper motor circuits housed within suitable cabinets 86 via their output lines 102. Each of the plurality of stepper motor and position indicator assemblies associated with a single elevator hoistway are of course disposed on different floors.

Figure 2:
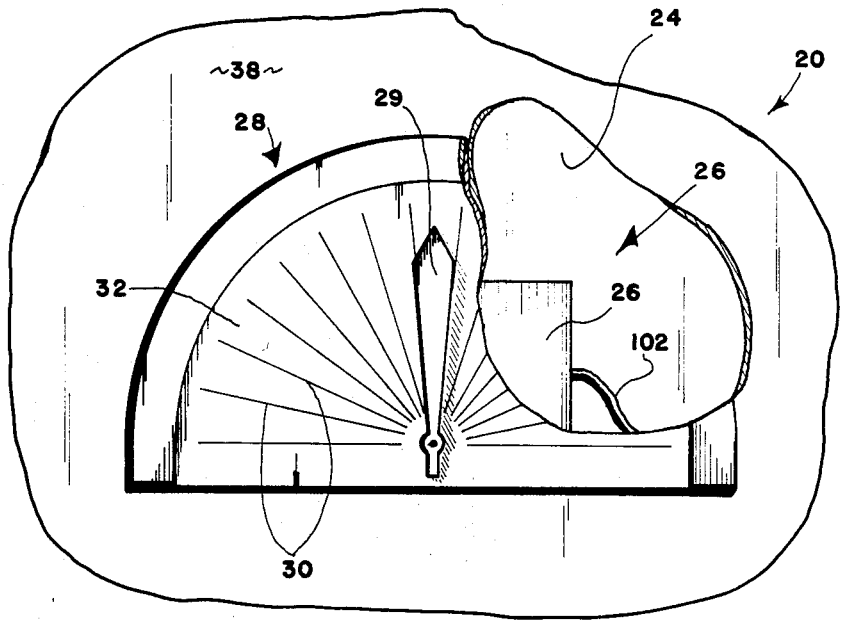
FIG. 2 is an enlarged, fragmentary plan view of the preferred elevator car floor indicator device of the present invention.
Figure 3:
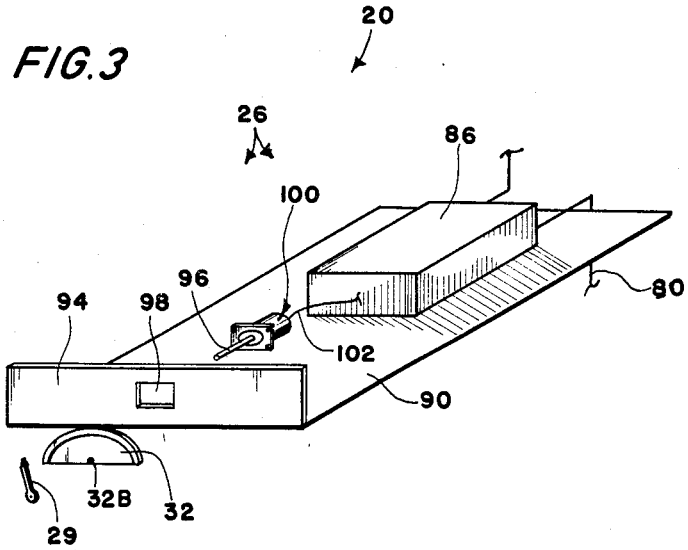
FIG. 3 is an exploded, isometric view of the floor indicator apparatus, with portions thereof omitted for clarity.
Figure 4:
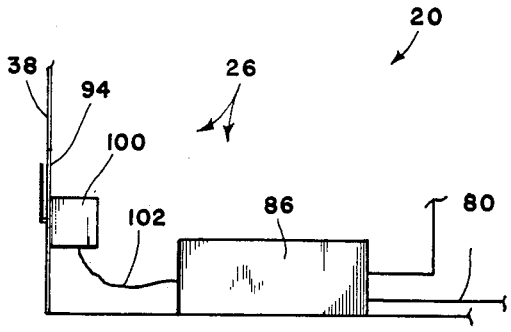
FIG. 4 is a reduced scale, side elevational view of the the position indicator apparatus of FIG. 2, as taken from a position generally to the right of FIG. 2; with portions thereof omitted or broken away for clarity.

With reference now to FIGS. 2 and 3, at each floor a suitable mounting panel 90 including an upwardly rising lip 94 is appropriately fitted with the indicator apparatus 28, comprising dial 32 and pointer 29 previously described. The pointer communicates with and is driven by a suitable shaft 96 projecting through orifice 98 within lip 94 and orifice 32B in dial 32. The stepper motor 100 which receives signals through line 102 from stepper motor control circuit housing 26 is ultimately driven by control signals processed and delivered by the circuit 104 of FIG. 8.

With reference now to FIG. 9, the solid state circuit generally indicated by the reference numeral 84 includes a power supply, generally designated by the reference numeral 110, and an associated processing circuit (which will later be described in detail), generally designated by the reference numeral 112. Nominally 115 volts a.c. is applied across terminals 114 and 115, and a ground is insured at terminal 116. Power inputted to a conventional SPST switch 120 is transmitted through a conventional fuse 122 to a suitable transformer 124. The output of transformer 124 is rectified across a conventional diode bridge circuit, generally designated by the reference numeral 126. Switch 120 will be manipulated by the service technician when the apparatus 20 is first installed and correctly set up. Appropriate filtering is accomplished via conventional capacitors 129 and 130, and a series resistor 132. Unregulated direct current is thus available at node 134 and upon line 136 which supplies unregulated voltage to node 138. Node 138 is electrically connected to node 138A (FIG. 10) whereby to power the optical circuit 139 preferably disposed within the housing of the vane reader 50. The power supply circuit 110 (FIG. 9) also generates a regulated 8 volt output through a conventional microcircuit 144 (FIG. 9), and regulated 8 volt direct current is thus transmitted via lines 148 and 149 to the circuit 112.

With reference to FIG. 9, the power supply 110 within circuit 84 includes output nodes 138, 150, and 152 which are electrically connected to corresponding input nodes 138A, 150A, and 152A respectively of the vane reader circuit 139 (FIG. 10). Unregulated direct current (between 12 to 14 volts) appearing at node 138A is transmitted through a diode 156 and a resistor 157 to transient suppression filter capacitors 162. A regulator chip 168, nominally an LM340, outputs a regulated 5volt signal on line 170, filtration and transient suppression being further accomplished through a plurality of parallel capacitors 172. The voltage appearing on line 170 and at nodes 178, 179 is employed to generate pulsating infrared light signals through suitable infrared emitting diodes (IRED's) disposed within the optical vane reader 50.

Voltage transmitted through resistor 180 to the collector 182 of transistor 184 is employed to suitably energize the infrared light emitting diode (IRED) 186 comprising the emitter load of transistor 184. IRED 186 is disposed within a suitable interior cavity 187 defined within the housing of the vane reader 50 (FIGS. 13, 14). Light generated by this IRED is aimed and transmitted across the gap 60, and a "B channel" light transmission path 61B results. When path 61B is unblocked, infrared light traverses gap 60 and penetrates polarized filter 196 and a suitably phased cooperative polarized filter 190 and impinges upon a suitable phototransistor 208 (FIGS. 10, 14), the operation of which will hereinafter be described. For retardation of incident ambient light the plane of polarization filters 190 and 196 (resulting from the crystalline grain of the filter structures) are disposed at ninety degrees to present an opaque medium through which ordinary white light cannot pass. However, because of the lower wavelength of the infrared beam the polarized filters 190 and 196 do not obstruct infrared light passage. IRED 208 is disposed within boss 205A, and it is mounted by a suitable grommet 208Q captured within boss 208R.

Similarly, resistor 200 delivers regulated 5 volt current to a transistor 202 whose emitter drives IRED 204. IRED 204 is disposed in the upper cavity 203 of the vane housing (FIG. 14) and it is retained by mounting grommet 204P. IRED 204 directs infrared light in the opposite direction across gap 60 thereby establishing an "A channel" light path generally designated by the reference numeral 61A (FIG. 13). Infrared light is directed through polarized filters 209 and 210 which are disposed within cavities 205A and 205B respectively. As before these filters prevent the admission of normal white light, and ambient light within the hoistway is therefore suppressed. Unobstructed infrared light may thus impinge upon phototransistor 198 which is identical to phototransistor 208 (FIG. 10), and which is similarly mounted in a boss 205E.

Thus an A-channel light path is established wherein an infrared beam is transmitted from the right to the left (as viewed in FIGS. 13 and 14) and a B-channel light path results from the transmission of infrared light from the left to the right. Light scatter and possible resultant channel crosstalk between these two channels are prevented by this uniquely oriented opposing pathway pairs of transmitter-to-receiver optical configuration.

Because of the time scale of the resultant waveforms depicted in FIG. 11, a graphical "high" merely indicates the impingement of light upon the receptive phototransistor and thus will correspond to the "unblocked" portion of light transmission. Thus the period of a "high" corresponds generally in time to mechanical movement of the elevator car. The time scale of the waveforms of FIG. 12, however, is greatly expanded and the period is in the order of thirty three microseconds. In FIG. 12 the pulse width "on time" is thus approximately 16.67 microseconds. This illustrates the 30 khz. pulsed nature of the fifty percent (50%) duty cycle IRED light transmissions, as will hereinafter become increasingly evident.

With reference directed again now to FIG. 10, a ring oscillator circuit, generally designated by the reference numeral 210R and comprised of a plurality of inverters 211, 212 and 213, outputs an approximately 30 khz. signal to node 216. Frequency is determined by a capacitor 217, nominally 0.025 mfd. This 30 khz. signal is transmitted to inverters 220 and 221, and to a line 218 applied to the base of transistor 202 via resistor 219. Light emanating from IRED 204 is thus switched on and off at approximately 30 khz. Similarly, IRED 186 is switched on and off by transistor 184, which receives an inverted 30 khz. signal from inverter 220 via a resistor 223 coupled to its base. Light from IRED 204 is thus 180 degrees out of phase from light transmitted by IRED 186.

The output of inverter 200 (FIG. 10) is also applied to an inverter 230 which outputs a first clock signal (CK1) on line 232 to pin 3 of a CMOS double D flip-flop circuit 234. A second clock signal (CK2) results from the output of inverter 221, which is applied via line 236 to pin 11 of circuit 235. Preferably flip-flop 234 is part of the same 4013 CMOS chip as similar flip-flop circuit 235. Preferably, inverters 211, 212, 213, 220, 221, and 230 are all part of one 4069 integrated CMOS circuit.

Providing that an unblocked light passageway exists across channel 60 of the optical vane reader 50 (FIG. 14), the A channel IRED 204 will excite the phototransistor 198, and the out-of-phase IRED 186 will excite phototransistor 208. Infrared photoresponsive divices 208 and 198 actually comprise phototransistor packages including a Schmitt trigger for rapid switching. Optron phototransistor model OPL800 has been found ideal.

Thus the Optron photoresponsive transistors 198 and 208 are driven by pulsed infrared light (when light passage is not interrupted) emanating from IREDs 204 and 186 respectively. The output of phototransistor 208 (FIG. 10) is transmitted via line 250 to pin 5 of circuit 234 and the output of phototransistor 198 is applied via line 252 to pin 9 of circuit 235. Both circuits 234 and 235 comprise D flip-flops and they are packaged in a single 4013 chip. Importantly, the B channel reception indicative signal appearing on line 250 is gated against the first clock signal inputted via line 232 to pin 3 of circuit 234. Similarly, the A channel reception indicative signal appearing on line 252 is gated by the second clock signal appearing on line 236. Correlation is thus achieved, in that the 4013 D flip-flop circuit confirms and determines either the presence of a light pulse which was actually transmitted, or the "correct" absence of a light pulse when a pulse is not being transmitted.

Correlation is initiated by the transition of the clock pulses to the "high" state. This correlation step insures protection against crosstalk between the two channels, and error which might otherwise result from "glitches" caused from electrical transients transmitted through the source power line, and from ambient light which may exist within the previously described hoistway. Protection against transients is particularly important within the electrical "inductive switching" environment of conventional elevator control hardware. In other words, the previously described correlation logic will insure that no "received signal" data from phototransistors 198 or 208 will be permitted to be outputted on lines 283 or 270 unless an appropriate drive signal has definitely been transmitted by the IRED's 186, 204 and correlated therewith.

Infrared light from IRED 204 is pulsed by the 30 khz. signal delivered from the ring oscillator to the base of transistor 202. The second clock signal (i.e. appearing on line 236) must gate the circuit 235 on the low to high signal. Inverter 221 further provides a time delay. Externally visible LED's 272 and 273 are driven by lines 270 and 238 respectively and project light from the sides of the vane reader 50 (FIGS. 10, 14) when the circuitry is operating properly. LED's 272, 273 (which are not infrared are mounted in suitable bosses 273E and 272E (FIG. 14). Thus the installing technician is provided with readily externally visible red light from LED indicators 272 and 273 which will indicate that the circuit is operational during the set-up and installation phases, greatly facilitating set-up alignment.

The output of circuit 234 (FIG. 10) on line 270 is also transmitted to pin 1 of circuit 280. Similarly, the output from circuit 235 appearing on line 283 is transmitted to pin 10 of the circuit 282. Circuit elements 280 and 282 comprise identical cooperating halves of a complementary communication chip, preferably a DS88C30. Thus the main drive signal, A1, appears on pin 9 and is delivered to a node 290, and the "NOT A1" signal is delivered to node 292. Similarly, pin 5 of the DS88C30 delivers the B1 signal to a node 294, and the "NOT B1" signal appears on node 296 which is coupled to pin 6 of the DS88C30. Thus node 294 transmits either a +5 or a 0-volt B1 signal and "NOT B1" is out of phase therewith. Node 290 receives a +5 or 0-volt A1 signal, and node 292 (i.e. NOT A1) is similarly out of phase.

Output nodes 294, 296, 290, and 292 (FIG. 10) are directly coupled to input nodes 294C, 296C, 290C, and 292C respectively (FIG. 9) by a conventional multiconductor cable 76 (FIG. 7) to drive circuit 112 (FIG. 9) preferably disposed within enclosure 78 (FIG. 1). IC 300 (FIG. 9) comprises a receiving device, nominally a DS88C20, which is electrically matched to the DS88C30 in accordance with RS422 specifications. Thus direct complementary communication is established between the signal outputs of FIG. 10 and the processing inputs of FIG. 9.

As previously mentioned, the power supply circuit 110 (FIG. 9) supplies Vcc for circuit 112 (regulated +8 volts DC). Vcc is supplied via lines 148 and 149 to pin 10 of circuit 300 (i.e., the DS88C20 matched communication device). This device outputs a "NOT A2" signal from its pin 6 to a node 302, NAND gating (i.e. for error reduction) being effectuated by the A1 signal inputted to its pin 1. The "NOT B1" signal inputted to pin 11 is NAND gated by the B1 signal on pin 13. The NOT B2 signal thusly outputted to line 304 from pin 8 of circuit 300 is transmitted to pin 5 of a 4013 IC, the first circuit half to which is represented generally by the reference numeral 306 and the other circuit half of which is represented by the reference numeral 307. The 4013 chip is a CMOS dual D flip-flop integrated circuit. The NAND gating of the NOT A1 and NOT B1 signals through circuit 300 further reduces crosstalk and circuit susceptibility to transmission errors caused by noise, ambient light, voltage spikes, transients and the like.

Node 302 communicates NOT A2 clock signals to pin 3 of circuit 306 and to lines 310 and 311. The NOT B2 signal outputted from pin 8 of circuit 300 is employed as a data line and is delivered via line 304 to pin 5 of the 4013. In circuit 306, a double D flip flop, the leading edge of the NOT A2 signal clocks against the NOT B2 data. As a result, the Q3 signal transmitted via line 320 to inverter 322 results in an inverted (but not gated) signal Q4. The NOT Q3 signal transmitted through line 323 to inverter 324 results in a NOT Q4 signal. The Q4 and NOT Q4 signals are applied to pins 2 and 4 respectively of a Motorola MMH 0026 integrated dual-driver-/inverter package 354, which is identical to circuit package 336. The DIR1 and NOT DIR1 signals (i.e. Direction control signals) outputted from circuit 354 to nodes 364 and 358 by lines 365 and 359 respectively are employed for stepper motor direction control and derivation, as will hereinafter be described in detail in conjunction with discussion of the stepper motor control circuitry of FIG. 8.

Direction is thus ultimately established based upon whether or not a sensed A transmission (i.e. on line 252 of FIG. 10) is interrupted before the sensed B signal (appearing on line 250 of FIG. 10), or vice versa. This occurs during elevator car movement because of the staggered relationship of the vane orifices 52 or 54, through which the pulsating infrared light from IRED's 204 and 186 is beamed.

With reference again to FIG. 9, pin 8 of the 4013 IC (circuit 307) is driven from node 302 by lines 310 and 311, and pin 10 is driven via line 310 and inverter 312. Thus a NOT A2 and an A2 signal appear at pins 8 and 10 respectively. NAND logic (of the 4013) transmits a Q5 signal to an inverter 313 and a NOT Q5 signal to an inverter 314. Inverters 312–314, 322, and 324 comprise individual inverter gate portions of a CMOS 4069 integrated circuit. Power is supplied from node 330 (FIG. 9) to pin 14 of circuit 307, and its pin 7 is grounded with node 331. Circuit 336 receivers a NOT A3 signal from inverter 314 on its pin 2 and inverts it, outputting signal A3 from pin 7 on line 338 to supply a clock signal CK at node 340. Similarly, signal A4 outputted from gate 313 is delivered to pin 4 of circuit 336 and an inverted NOT A4 signal is transmitted from pin 5 via line 343 to provide a NOT CK signal at output node 350. Node 352 provides ground communication. The two clock signals appearing at nodes 340 and 350 are employed to ultimately drive each stepping motor as will hereinafter be described to provide an indication at each of the floors through the plurality of stepper motor assemblies 26.

With reference now to the stepping motor power supply and control circuit 104 (FIG. 8) the circuit input nodes 340E, 350E, 364E, 358E, and 352E are respectively coupled to corresponding output nodes 340, 350, 364, 358 and 352 illustrated in FIG. 9. Each of the elevator floor positions will include a suitable stepper motor assembly and stepper motor circuit for actuating one of a plurality of floor indicator and direction indicator devices 28 (FIG. 1). The power supply 370 includes a transformer 372 which is coupled across nominally 115 volts AC and drives a conventional diode bridge 374, which outputs unfiltered DC to a conventional RC filter 371. Direct current is supplied to conventional regulator circuit 375 at node 376. Regulated 12 volt DC power (i.e. Vcc) is outputted across nodes 378 and 380.

Figure 8:
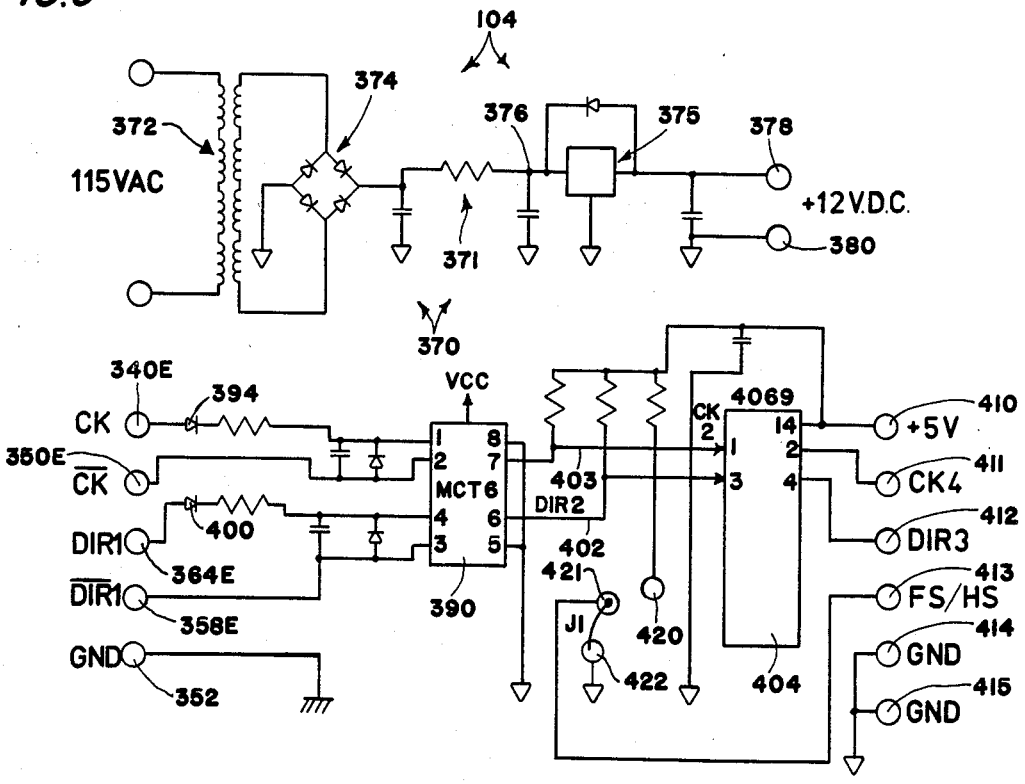
FIG. 8 is an electrical schematic diagram of the preferred stepper motor control apparatus employed for generating an appropriate display of elevator car position.

The clock signal (CK) inputted to node 340E is transmitted to pin 1 of an MCT6 dual optical coupler 390 (FIG. 8). The NOT CK clock signal at node 350E is transmitted directly to pin 2 of circuit 390. Diode 394 is employed to prevent actuation of circuit 390 unless the CK signal is higher than the NOT CK clock signal. The DIR direction signal appearing at node 364E is similarly transmitted through a diode 400 to pin 4 of circuit 390 and the NOT DIR signal at node 358E is transmitted to pin 3. The optic coupler provides a DIR2 signal on line 402 which is transmitted to pin 3 of a circuit 404 comprising a 4069 hex inverter IC.

Clock signal CK2 outputted from pin 7 of circuit 390 is transmitted through a line 403 to pin 1 of circuit 404, a 4069 hex buffer. The opto-coupler 390 (MCT6) gates the clock signal CK with the NOT CK signal to obtain the output CK2. Similarly the DIR signal is gated by the NOT DIR signal to obtain the DIR2 output. In this fashion continuous continuity is insured because NAND gate logic is employed to provide incremental counts only when both of the original A and B signals developed across the vane reader 50 (i.e., through the orifices in the vane) are properly timed. This double integrity form of logic insures reduction of noise susceptibility, and, as explained earlier, reduces crosstalk.

The output from the 4069 appear on nodes 410–415. These outputs are delivered to the appropriate pins on the conventional stepper control circuit board, which comprises a commercially available Clifton Precision Model 23-SHAB-03BU/H201. This stepper motor control board drives a commercially available Clifton Precision brand bipolar four pole, two amp drive stepper motor, preferably comprising Model LR-BP-20-35. The stepper motor mechanically rotates the indicator pointer 29 (FIGS. 1,2) to provide floor level indication at each of the installed elevator floors through the various indicators 28. The main clocking signal outputted on node 411 is labeled CK4. This signal increments the stepper motor assembly in user selectable angular deviations. The direction control signal is established at node 412, and it is labeled DIR 3. This signal establishes which direction the stepper motor should turn the pointer 29.

Circuit 104 (FIG. 8) provides jumper-selectable control deflection of either 0.9 degrees per step or 1.8 degrees per step. To this effect a conventional jumper is employed in conjunction with nodes 420, 421, and 422. It is preferred to operate at 0.9 degrees per step, in which case nodes 421 and 422 are coupled together through the indicated jumper J-1. If 1.8 degrees per step are desired, a jumper connection across indicated nodes 421 and 420 is installed instead.

Prior to initial installation a preliminary engineering calculation must be made in order to "match" the hardware of the present system to the contemplated installation. Specifically, the number of floors (or alternatively the number of stations) between which the car or object will be moving must be correlated with the number of incremental steps and corresponding stepper motor and pointer deflection degrees that the stepper motor must move in order to provide full scale deflection (i.e. 180 degrees pointer rotation). For example, when the car is disposed at the first floor (or the monitored object is disposed at its base position) the pointer 29 will preferably be disposed in a "zero degree" position, rotated to the maximum counterclockwise position relative to the calibrated faceplate. When the car travels to its highest position (i.e. the top floor), or when the monitored travelling object is disposed at its end position (i.e. maximum travel), the pointer must be deflected to the 180 degree or maximum clockwise arc position. Obviously the faceplate will be calibrated and marked in accordance with the intended installation application.

Normally the full scale deflection of each pointer is 180 degrees. The latter fact is compared to the incremental shift of the stepper motor per clock signal, which is user selectable at increments of E degrees per pulse. And, depending upon the preselected jumper connection of nodes 420–422 (FIG. 8) previously discussed, E will be either 0.9 or 1.8. Each vane is arranged to provide an incremental count corresponding to N degrees per vane, where N is computed by dividing 180 degrees by a number D, where D is equal to one less than the number of floors (or travel stations). Then N multiplied times the reciprocal of E (i.e. N/E) yields a number S corresponding to steps per vane. The number of perforations per vane channel is computed by subtracting 1 from the number S. In the best mode the length of each vane in inches is preferably computed doubling the number of required perforations calculated as above, and adding 0.75 inches. The preferred spacing of perforations, and the preferred dimension of each square perforation is thus 0.75 inches.

In the best mode, by way of example, the preferred width between the edges 44E and 44F of vane body portion 45 is 2.5 inches. The perforation rows are separated by a distance 53 of 0.25 inches, and the square perforations measure 0.75 inches by 0.75 inches, being spaced from one another by 0.75 inches. For a hoistway of 22 feet wherein adjacent floors are separated by 11 feet, sequential vanes are separated by two feet. As also generally indicated by the dimension line 53 (FIG. 11), a light path may be established simultaneously between adjacent perforations 54N and 54M, for example, for a distance corresponding to approximately one half of the length of each perforation, in order to generate appropriate phase change information for determining the direction of car travel.

With combined reference now to FIGS. 11 and 12 it will first be appreciated that the time scale of the waveforms in FIG. 11 is in the order of milliseconds, while the time scale of of the waveforms of FIG. 12 is in the order of microseconds. It will be noted from an inspection of a typical vane 44 that the orifices 52 comprising the A signal generator orifices are elevated or ∓offset" from the similar spaced-apart row of B generator orifices 54. It will also be noted that if optical vane reader 50 is moving upwardly relative to vane 44, a light path will be established between IRED 204 and phototransistor 198 prior to the establishment of light communication between IRED 186 and phototransistor 208. However, for a certain portion of the travel it will be apparent that both a B and an A signal will be transmitted and this linear distance corresponds to roughly one half the dimension of either of the orifices 52 or 54. The A signals of FIG. 11 are thus approximately 90 degrees out of phse with the B signals corresponding with this mechanical offset.

In other words, when the elevator car is moving upwardly, it will be apparent that waveform 62 lags wave train 68. However, a comparison of wave form 62D (FIG. 11) with waveform 68D will indicate that when the elevator car is moving down, the A signal will lead the B signal approximately 90 degrees. This lead and lag phase relationship is employed ultimately to determine the direction indicator signals previously described.

With reference to FIGS. 9 and 11, waveform 71A (Q3) indicates the voltage appearing during upward car travel at pin 1 of the 4013 circuit 306. This signal is high during the interval that the elevator car is moving upwardly, as determined by the phase delay between the original A and B signals. As previously described, the DIR1 output on node 364 provides a positive directional signal to each of the individual stepper motor circuits. Similarly, signal trace 70E (FIG. 11) shows the Q3 value during downward travel (i.e. the "low" state) and this similarly corresponds to the voltage at pin 1 of circuit 306 in FIG. 9.

In FIG. 12 waveform 500 corresponds to a 30 khz. "A transmit" signal which is high whenever IRED 204 (FIG. 10) is "on," beaming infrared light which is pulsed at approximately 30 khz. to generate a plurality of peaks 502. The signal waveform 504 (FIG. 12) shows the CK2 signal outputted from inverter 221 (FIG. 10) which is applied to pin 11 of IC portion 235. It will be noted that waveforms 500 and 504 are essentially inverted from one another. Arrowheads have been added to waveforms 504 and 512 in FIG. 12 to illustrate the trigger point of IC's 234 and 235.

Waveform 506 (FIG. 12) corresponds to the output of the phototransistor 198 (FIG. 10) which appears on line 252; the output is pulsed, as indicated by peaks 508 in FIG. 12. However, once metal from the vanes 44 interrupts light pathway 61A (FIG. 13), light from IRED 204 will be interrupted, so that the voltage appearing on line 252 will be temporarily low as indicated by trace portion 510 of FIG. 12. However, since line 283 (FIG. 10) outputted from circuit 235 is gated from line 236 by the ring oscillator 210R, a time delay between the cessation of pulse 514 and the subsequent transition 518B of Q2 will result (i.e. gating is effectuated by the "high" transition of waveform 504 illustrated by arrowhead 503).

Waveform 518 of FIG. 12 thus corresponds to Q2. Similarly, when the vane becomes unblocked waveform 506 will return high only after proper "up transition" gating from line 236, as illustrated at 579. CK2 is the inversion of A XMIT, and the upstroke represented at 503 occurs at the end of a transmit signal to insure that light has crossed the gap vane reader 60.

Waveform 511 (B Xmit) corresponds to the voltage impressed across IRED 186 (FIG. 10); its complement, CK1, corresponds to waveform 512 in FIG. 12, and this voltage gates IC 234. Waveform 513 corresponds to the output of phototransistor 208 appearing on line 250. As indicated at 523, light passage is interrupted. The corresponding signal Q1 drops accordingly between high 519 and low 520, but not until the next CK1 "upstroke" of waveform 512.

In FIG. 12 time interval 560 occurs during upward "between vane" car travel, when light passage is unblocked. Interval 562 starts immediately when the first B light transmission is blocked, and continues until the first A light transmission is thereafter blocked. Interval 564 occurs during the time when both the A and B channels are blocked; it ends with the unblockage of the B light pathway. It will be noted that the Q1 transition (i.e. high 567) occurs concurrently with waveform 514 returned to a "high" state and CK1 rising. Time interval 566 ends when Q2 (waveform 518) goes high in response to both the prior rise of waveform 506 (i.e. pulse 577) and the rise transition 579 of the CK2 signal.

As the car continues to rise, the cycle will repeat, and the direction pointers and all stepper motors will be governed accordingly. When the elevator car travels downwardly, the CK1 and CK2 timing signals are unchanged. Since the A light path will be interrupted prior to interruption of the B light path, Q1 and A2 will be varied accordingly, and appropriate stepper motor direction control signals DIR1 and NOT DIR1 (FIG. 9) will result. Incremental stepper motor displacement rates will remain the same.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing form the scope thereof, it is to be understood that all matte herein set forth or shown in the accompanying drawings is to be interpreted as illustrative and not in a limiting sense.

What is claimed is:

1. A relative position determining system for monitoring the travel of moveable objects such as an elevator car disposed for vertical displacement within a conventional elevator hoistway, said system comprising:

a plurality of relative position indicator means including displays for visibly indicating elevator car position and the direction of car travel, at least one of said display means disposed at each floor serviced by said elevator car;

a plurality of separate, vertically spaced apart vane means disposed in generally aligned relation within said hoistway, each of said vanes including an A row of periodically spaced apart perforations and a cooperating B row of periodically spaced apart perforations, said A row being offset from said B row of perforations;

vane reader means adapted to be moved by said elevator car for generating digital position data from said vane means, said reader means including circuit means adapted to aim and intermittently receive a first beam of light through said A row of perforations and to aim and intermittently receive a second beam of light through said B row of perforations, said first beam of light being directed in a first direction and said second beam of light being directed in an opposite direction;

said vane reader circuit means responsive to said first and second beams of light for outputting a first pair of complementary digital signals A1 and NOT A1 derived from said A row and a second pair of complementary digital signals B1 and NOT B1 derived from said B row;

drive circuit means for correlating said A1 and NOT A1 signals whereby to derive and output CK and NOT CK clock signals and responsive to said B1 and NOT B1 signals whereby to derive and output DIR 1 and NOT DIR1 direction signals; and, stepper motor control means associated with each of said relative position indicator means, each of said stepper motor control means including stepper motor circuit means responsive to said CK and NOT CK clock signals for generating a stepper motor clock signal, and responsive to said DIR 1 and NOT DIR1 direction signals for generating a stepper motor control direction signal for actuating a stepper motor to thus display elevator car position and/or direction of travel.

2. The system as defined in claim 1 wherein said vane reader means includes a pair of opposite sides separated by a channellike void across which said light beams are projected and within which said vanes may be at least temporarily interposed during elevator car movement.

3. The system as defined in claim 2 wherein said said vane reader circuit means includes a first IRED for generating said first beam of light and a second IRED for generating said second beam of light, means for rapidly pulsing said first IRED and said second IRED, said first IRED being pulsed out of phase with said second IRED, a first photosensitive transducer for sensing light emanating from said first IRED, and a second photosensitive transducer for sensing light emanating from said second IRED.

4. The system as defined in claim 3 wherein said vane reader circuit means comprises:

first correlation means for generating a clock output responsive to an output from said first photosensitive transducer depending on the state of first IRED;

second correlation means for generating a clock output in response to the output of said second photosensitive transducer depending on the state of said second IRED; and, wherein said A1 and NOT A1 signals are generated in response to the correlated clock output from said first correlation means and said B1 and NOT B1 signals being generated in response to the correlated output of said second correlation means.

5. The system as defined in claim 4 wherein said vane reader means includes visible light generation means activated when said first and second IRED's are activated to provide a visible light warning to the installing technician of the operation of said vane reader circuit means.

6. The system as defined in claim 4 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal whereby to output a pair of complementary CK and NOT CK clock drive signals;

means for correlating said NOT B1 signal with said B1 signal to produce a NOT B2 signal; and, means for correlating said NOT B2 signal with said NOT A2 signal whereby to output a pair of complementary DIR 1 and NOT DIR 1 direction control signals.

7. The system as defined in claim 6 wherein said stepper motor control circuit includes means for correlating said CK clock signal against said NOT CK clock signal to output a stepper motor clock signal, and means for correlating said DIR1 direction signal with said NOT DIR1 direction signal to output a stepper motor directional signal.

8. The system as defined in claim 7 wherein said vane reader means comprises first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

9. The system as defined in claim 8 including first jumper selectable means providing an incremental stepping motor control signal of 0.9 degrees per pulse, and second user selectable jumper means for establishing 18 degrees stepper motor deflection per pulse.

10. The system as defined in claim 7 wherein said vane reader means includes visible light generation means activated when said first and second IRED's are activated to provide a visible light warning to the installing technician of the operation of said vane reader circuit means.

11. The system as defined in claim 4 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal to provide a NOT Q5 signal and a Q5 signal;

means for inverting said NOT Q5 signal to derive a NOT A3 signal and means for inverting said Q5 signal to generate an A4 signal;

means for correlating said NOT A3 signal against said A4 signal to generate an A3 signal and a NOT A4 signal corresponding respectively to said CK and NOT CK clock signals.

12. The system as defined in claim 11 wherein said vane reader means includes visible light generation means activated when said first and second IRED's are activated to provide a visible light warning to the installing technician of the operation of said vane reader circuit means.

13. The system as defined in claim 11 wherein said stepper motor control circuit includes means for correlating said CK clock signal against said NOT CK clock signal to output a stepper motor clock signal, and means for correlating said DIR1 direction signal with said NOT DIR1 direction signal to output a stepper motor directional signal.

14. The system as defined in claim 13 wherein said vane reader means comprises first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

15. The system as defined in claim 14 including first jumper selectable means providing an incremental stepping motor control signal of 0.9 degrees per pulse, and second user selectable jumper means for establishing 1.8 degrees stepper motor deflection per pulse.

16. The system as defined in claim 15 wherein said vane reader means includes visible light generation means activated when said first and second IRED's are activated to provide a visible light warning to the installing technician of the operation of said vane reader circuit means.

17. A solid state reader device for deriving and monitoring the travel of moveable objects such as an elevator car disposed for vertical displacement within a conventional elevator hoistway equipped with a plurality of similar spaced apart vanes, each of said vanes including an A row of periodically spaced apart perforations and a cooperating B row of periodically spaced apart perforations, said A row being offset from said B row of perforations; said reader device comprising:

means coupling said vane reader means for movement by said elevator car for generating digital position data from said vane means;

circuit means adapted to aim and intermittently receive a first beam of infrared light through said A row of perforations and to aim and intermittently receive a second beam of infrared light through said B row of perforations, said first beam of light being directed in a first direction and said second beam of light being directed in an opposite direction; and, said vane reader circuit means being responsive to said first and second infrared beams of light for outputting a first pair of complementary digital signals A1 and NOT A1 derived from said A row and a second pair of complementary digital signals B1 and NOT B1 derived from said B row.

18. The reader device of claim 17 wherein said vane reader circuit means comprises:

A channel and B channel IRED means for generating said infrared light beams;

A channel and B channel photoresponsive elements for sensing said light beams, said last mentioned elements having outputs;

means for periodically pulsing said IRED's, the B channel IRED being out of phase with said A channel IRED;

means for deriving CK1 and CK2 clocking signals from said pulsing means;

means for generating said A1 and NOT A1 signals by clocking said A channel output against said CK2 clocking signal; and, means for generating said B1 and NOT B1 signals by clocking said B channel output against said CK1 clocking signal.

19. The reader device as defined in claim 18 wherein said drive circuit means includes means for correlating said A1 and NOT A1 signals whereby to derive and output CK and NOT CK clock signals and responsive to said B1 and NOT B1 signals whereby to derive and output DIR 1 and NOT DIR1 direction signals, whereby to appropriately control a plurality of stepper-motor-driven relative position indicator means including displays for visibly indicating elevator car position and the direction of car travel, at least one of said display means disposed at each floor serviced by said elevator car, each of said stepper motor control means including stepper motor circuit means responsive to said CK and NOT CK clock signals for generating a stepper motor clock signal, and responsive to said DIR 1 and NOT DIR1 direction signals for generating a stepper motor control direction signal for actuating the stepper motor to thus display elevator car position and/or direction of travel.

20. The reader device as defined in claim 19 including a housing having pair of opposite sides separated by a channel-like void across which said light beams are projected and within which said vanes may be at least temporarily interposed during elevator car movement.

21. The reader device as defined in claim 20 wherein said vane reader circuit means includes a first IRED for generating said first beam of light and a second IRED for generating said second beam of light, means for rapidly pulsing said first IRED and said second IRED, said first IRED being pulsed out of phase with said second IRED, a first photosensitive transducer for sensing light emanating from said first IRED, and a second photosensitive transducer for sensing light emanating from said second IRED.

22. The reader device as defined in claim 21 wherein said vane reader circuit means comprises:

first correlation means for generating a clock output responsive to an output from said first photosensitive transducer depending on the state of said first IRED;

second correlation means for generating clock output in response to the output of said second photosensitive means depending on the state of said second IRED; and, wherein said A1 and NOT A1 signals are generated in response to the correlated clock output from said first correlation means and said B1 and NOT B1 signals being generated in response to the correlated output of said second correlation means.

23. The reader device as defined in claim 22 including visible light generation means activated when said first and second IRED's are activated to provide a visible light warning to the installing technician of the operation of said vane reader circuit means.

24. The reader device as defined in claim 22 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal whereby to output a pair of complementary CK and NOT CK clock drive signals;

means for correlating said NOT B1 signal with said B1 signal to produce a NOT B2 signal; and, means for correlating said NOT B2 signal with said NOT A2 signal whereby to output a pair of complementary DIR 1 and NOT DIR 1 direction control signals.

25. The reader device as defined in claim 24 including first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

26. The reader device as defined in claim 25 including visible light generation means activated when said first and second IRED's are activated to provide a visible light warning to the installing technician of the operation of said vane reader circuit means.

27. The reader device as defined in claim 22 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal to provide a NOT Q5 signal and a Q5 signal;

means for inverting said NOT Q5 signal to derive a NOT A3 signal and means for inverting said Q5 signal to generate an A4 signal;

means for correlating said NOT A3 signal against said A4 signal to generate an A3 signal and a NOT A4 signal corresponding respectively to said CK and NOT CK clock signals.

28. The device as defined in claim 27 including visible light generation means activated when said first and second IRED's are activated to provide a visible light warning to the installing technician of the operation of said vane reader circuit means.

29. The device as defined in claim 28 including first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

30. The reader device as defined in claim 29 wherein said stepper motor control circuit includes means for correlating said CK clock signal against said NOT CK clock signal to output a stepper motor clock signal, and means for correlating said DIR1 direction signal with said NOT DIR1 direction signal to output a stepper motor directional signal.

31. A system for determining, monitoring and displaying the relative position of displaceable objects such as elevator cars or the like which are adapted to be moved between a plurality of preselected travel positions along a predetermined travel route, said system comprising:

a plurality of relative position indicator means including displays for visibly indicating object position and travel direction, at least one of said display means disposed at each of said preselected positions along said travel route;

a plurality of separate, spaced apart vane means disposed in generally aligned relation along said travel route, each of said vanes including an A row of periodically space apart perforations and a cooperating B row of periodically spaced apart perforations;

vane reader means adapted to travel with said object for generating digital position data from said vane means, said vane reader means including circuit means adapted to aim and intermittently receive a first beam of light through said A row of perforations and to aim and intermittently receive a second beam of light through said B row of perforations, said first beam of light being directed in a first direction and said second beam of light being directed in an opposite direction, said vane means including a pair of opposite sides separated by a channel-like void across which said light beams are projected and within which said vane means may be at least temporarily interposed during vane reader means movement;

said vane reader circuit means responsive to said first and second beams of light for outputting a first pair of complementary digital signals A1 and NOT A1 derived from said A row and a second pair of complementary digital signals B1 and NOT B1 derived from said B row;

drive circuit means for correlating said A1 and NOT A1 signals whereby to derive and output CK and NOT CK clock signals and responsive to said B1 and NOT B1 signals whereby to derive and output DIR 1 and NOT DIR1 direction signals; and, stepper motor control means associated with each of said relative position indicator means and responsive to said CK and NOT CK clock signals for generating a stepper motor clock signal, and responsive to said DIR1 and NOT DIR1 direction signals for generating a stepper motor control direction signal for actuating an associated stepper motor for displaying relative object position and travel direction.

32. The system as defined in claim 31 wherein said said vane reader circuit means comprises:

a first IRED for generating said first beam of light and a second IRED for generating said second beam of light;

means for rapidly pulsing said first IRED out of phase with said second IRED so that said first IRED is on when said second IRED is off and vice versa;

a first photosensitive transducer for sensing light emanating from said first IRED, and a second photosensitive transducer for sensing light emanating from said second IRED;

first correlation means for generating a clock output responsive to an output from said first photosensitive transducer depending on the state of said first IRED;

second correlation means for generating a clock output in response to the output of said second photosensitive means depending on the state of said second IRED;

said A1 and NOT A1 signals being generated in response to the correlated clock output from said first correlation means; and, said B1 and NOT B1 signals being generated in response to the correlated output of said second correlation means.

33. The system as defined in claim 32 wherein said vane reader means includes visible light generation means activated when said first and second IRED's are activated to provide a visible light warning to the installing technician of the operation of said vane reader circuit means.

34. The system as defined in claim 32 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal whereby to output a pair of complementary CK and NOT CK clock drive signals;

means for correlating said NOT B1 signal with said B1 signal to produce a NOT B2 signal; and, means for correlating said NOT B2 signal with said NOT A2 signal whereby to output a pair of complementary DIR 1 and NOT DIR 1 direction control signals.

35. The system as defined in claim 34 wherein said stepper motor control means includes circuit means for correlating said CK clock signal against said NOT CK clock signal to output a stepper motor clock signal, and means for correlating said DIR1 direction signal with said NOT DIR1 direction signal to output a stepper motor directional signal.

36. The system as defined in claim 35 wherein said vane reader means comprises first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

37. The system as defined in claim 36 wherein said vane reader means includes visible light generation means activated when said first and second IRED's are activated to provide a visible light warning to the installing technician of the operation of said vane reader circuit means.

38. The system as defined in claim 32 wherein said drive circuit means includes:

means for correlating said NOT A1 signal with said A1 signal to derive a NOT A2 signal;

means for generating an A2 signal from said NOT A2 signal;

means for correlating said NOT A2 signal with said A2 signal to provide a NOT Q5 signal and a Q5 signal;

means for inverting said NOT Q5 signal to determine a NOT Q3 signal and means for inverting said Q5 signal to generate an A4 signal; and, means for correlating said NOT A3 signal against said A4 signal to generate an A3 signal and a NOT A4 signal corresponding to said CK and NOT CK clock signals.

39. The system as defined in claim 38 wherein said vane reader means includes visible light generation means activated when said first and second IRED's are activated to provide a visible light warning to the installing technician of the operation of said vane reader circuit means.

40. The system as defined in claim 38 wherein said stepper motor control means includes circuit means for correlating said CK clock signal against said NOT CK clock signal to output a stepper motor clock signal, and means for correlating said DIR1 direction signal with said NOT DIR1 direction signal to output a stepper motor directional signal.

41. The system as defined in claim 40 wherein said vane reader means comprises first polarized filter means disposed in said first light beam pathway for suppressing ambient white light and second polarized filter means disposed in said second light beam pathway for suppressing ambient white light, both of said first and second polarized filter means concurrently facilitating the passage of infrared light.

42. The system as defined in claim 41 wherein said vane reader means includes visible light generation means activated when said first and second IRED's are activated to provide a visible light warning to the installing technician of the operation of said vane reader circuit means.

* * * * *